US006014802A

United States Patent [19]

Guerin

[11] Patent Number: 6,014,802

[45] Date of Patent: Jan. 18, 2000

[54] SHOCK-OPERATED RIVETING APPARATUS AND METHOD FOR OPERATING THIS DEVICE

[75] Inventor: Sylvain Guerin, Seclin, France

[73] Assignee: Dassault-Aviation, Paris, France

[21] Appl. No.: 08/728,059

[22] Filed: Oct. 9, 1996

[30] Foreign Application Priority Data

Oct. 11, 1995 [FR] France ..... 95 11935

[51] Int. Cl.[7] ..... B23Q 17/00; B21J 15/26

[52] U.S. Cl. ..... 29/407.01; 29/525.06; 29/714

[58] Field of Search ..... 29/243.53, 701, 29/714, 407.01, 525.06, 243.521, 243.526; 901/32, 38, 41; 227/58, 51; 408/236

[56] References Cited

U.S. PATENT DOCUMENTS

| | | | |
|---|---|---|---|
| 1,483,919 | 2/1924 | Walker . | |
| 4,589,184 | 5/1986 | Asano et al. | 29/430 |
| 4,720,897 | 1/1988 | Orrell et al. | 29/26 |
| 4,762,261 | 8/1988 | Hawly et al. | 29/243.53 |
| 4,854,491 | 8/1989 | Stoewer | 227/58 |
| 4,885,836 | 12/1989 | Bonomi et al. | 227/58 |
| 4,955,119 | 9/1990 | Bonomi et al. . | |
| 4,967,947 | 11/1990 | Sarh | 227/51 |
| 4,995,148 | 2/1991 | Bonomi et al. . | |
| 4,999,896 | 3/1991 | Mangus et al. | 29/34 |
| 5,136,873 | 8/1992 | Hopkins et al. | 29/243.521 |
| 5,231,747 | 8/1993 | Clark et al. | 29/243.53 |
| 5,473,805 | 12/1995 | Wille . | |
| 5,621,963 | 4/1997 | Givler | 29/525.06 |
| 5,634,746 | 6/1997 | Ffield et al. | 408/1 R |

FOREIGN PATENT DOCUMENTS

0527414A1 9/1993 European Pat. Off. .

OTHER PUBLICATIONS

French Search Report, Jul. 1, 1996.

*Primary Examiner*—Lee Young
*Assistant Examiner*—A. Dexter Tugbang
*Attorney, Agent, or Firm*—Stevens, Davis, Miller & Mosher, L.L.P.

[57] ABSTRACT

Two riveting-set assemblies (14) are each mounted on a carrier device (4, 5) which may be an effector mounted on a robot arm (A, B), on each side of the workpieces (2, 3) to be joined by riveting. Each carrier device is provided with driving means which comprise an electric motor (21), preferably a brushless motor, which drives the riveting-set assembly translationally, for example via ball screws (18, 19). Control means (25) are designed to actuate the two motors (21) in such a manner that the riveting sets (14) encounter the rivet (1) with a time delay and/or a kinetic energy difference which are chosen in order to form the rivet in the desired manner, avoiding, at the workpieces to be joined, undesirable movements or stresses.

9 Claims, 2 Drawing Sheets

SHOCK-OPERATED RIVETING APPARATUS AND METHOD FOR OPERATING THIS DEVICE

The present invention relates to a riveting apparatus and a method for operating this apparatus.

BACKGROUND OF THE INVENTION

A rivet is a joining device intended to join together two or more workpieces each drilled with a hole. The rivet includes a shank which is intended to be inserted into the holes in the workpieces, after these holes have been brought into axial coincidence. The shank must be inserted into the holes in such a manner that part of the shank projects from each of the ends of the passage formed by the juxtaposed holes. The shank is deformable and/or is combined with a deformable ring which forms part of the rivet.

In order to join the workpieces together, forces are applied to the rivet such that it deforms until it has, in the vicinity of the two ends of the passage, enlarged parts in clamping contact with the corresponding workpieces.

The deformation of the rivet may be achieved using slowly-acting forces or by single or repeated shocks.

It is often important, during deformation of the rivet, for the movements of the workpieces to be joined, or the stresses which they experience, to be small and/or tightly controlled.

Deformation induced by slowly-acting forces allows the movements of the workpieces and their stresses to be accurately controlled, but it requires heavy tooling in order to apply large forces.

Shock-induced deformation requires much lighter tooling, but it is difficult to control the position of the workpieces to be joined and may subject them to high stresses.

In the case of shock-induced deformation, an "anvil" is normally used, that is to say a piece which may be considered as being fixed and non-deformable, one end of the rivet is placed so as to bear on the anvil and the shock or shocks are exerted using a "riveting set" which acts on the opposite end of the rivet shank. This manner of operating is not entirely satisfactory from a theoretical standpoint since the deformation of that part of the rivet which is close to the anvil results in a slight movement, or deformation, of the workpieces. Furthermore, the need to have a fixed anvil or a large mass is an irksome constraint.

It may be imagined that it is more advantageous to exert the shocks on both ends of the rivet shank, but the manner in which the shock energy is applied to each of the ends of the rivet must be controlled very accurately in order to avoid movements of the rivets in its hole and of the workpieces to be joined or stresses on these workpieces.

More precisely, if the rivet to be formed initially consists of a homogeneous symmetrical cylindrical piece placed symmetrically with respect to the workpieces to be riveted, it is clear that the result, with regard to the movements and stresses imposed on these workpieces, will be all the better the smaller the difference between the kinetic energies of the two percussion tools and the shorter the time interval separating their impact on one end of the rivet. This will not be exactly the same in the case where the rivet to be formed is not symmetrical, and has a head, for example. Many other factors may be involved: for example, assuming that a shock is the very rapid application of a force on an object, the way in which this force varies is not without importance.

In order to simplify matters, the rest of the text will speak of "synchronous percussions" and of equal kinetic energies, it being necessary, however, always to take account of the reservations which have just been mentioned.

The document U.S. Pat. No. 3,704,506 proposes to execute "synchronous percussions" by providing, on each side of the rivet, a riveting set combined with a propulsion means which includes an electrical coil into which an electric current may be sent coming from the discharge of capacitors. The riveting set is firstly made to bear on the rivet and then the electric current sent into the coil gives the riveting set a force sufficient to deform the rivet.

The document U.S. Pat. No. 4,862,043 contains a critique of this prior-art process. According to this document, even if the riveting set is already in contact with the rivet before the operation, the prior art is of the "ballistic" type, that is to say the energy is supplied to the riveting set in a time appreciably shorter than that during which the material of the rivet, and of the workpieces, deforms, which would be the cause of deformations. U.S. Pat. No. 4,862,043 proposes to remedy this drawback by having a conformation which ensures that the force acting on the riveting set acts for a time which is approximately equal to that for deformation of the rivet and of the workpieces.

The electromagnetically actuated devices described hereinabove may be reproached on the grounds of being expensive, heavy and bulky.

Moreover, pneumatic riveting guns are known, see for example the document U.S. Pat. No. 4,039,034, with a piston which can move in a cylinder and a compressed-air accumulator intended to move the piston until it strikes a riveting set. These guns are provided with a manually actuated trigger. It is doubtful whether it is possible to combine them with means allowing, with sufficient accuracy, simultaneous triggering of two guns, equal and stable pressures in both accumulators and identical strokes for the pistons, in particular because of the difficulty of controlling the pressure oscillations in the pipes and in the accumulator.

The document U.S. Pat. No. 3,562,893 provides a system having two riveting sets acting in opposition, one being actuated by compressed air and the other by an explosive charge triggered by the impact of the first riveting set on the rivet. There is no overall symmetry between the two tools, which do not operate in a really synchronous fashion. Tailoring this system to different types of rivets is evidently difficult.

SUMMARY OF THE INVENTION

The object of the present invention is to provide a riveting apparatus which, operating according to the "synchronous percussion" principle, is simpler, less bulky, easier to use and less expensive than those of the prior art.

In order to achieve this aim, the invention provides a riveting apparatus of the type comprising two tools capable of acting in a substantially synchronous manner on the opposite ends of a rivet, this apparatus including two carrier devices, on each of which is mounted a riveting-set assembly, which can move along a defined path, means for keeping the carrier devices in a position such that, when an active face of the riveting set comes into contact with a corresponding end of the rivet, this active face moves substantially parallel to the axis of the rivet, each carrier device being provided with driving means capable of communicating to the corresponding riveting set, moving along its path toward the other, sufficient energy to form the rivet, control means being provided for actuating the driving means approximately simultaneously, this apparatus having the particular feature that the driving means each include an electric motor capable of imparting a velocity to the riveting set assembly such that, when the riveting set encounters the rivet, the riveting-set assembly has sufficient kinetic energy to form the rivet, and the control means are capable of actuating the two driving means in such a manner that the riveting sets encounter the rivet to be formed with a time delay and with a kinetic energy difference which are less than chosen limits in order to avoid, at the workpieces to be joined, excessive movements or stresses.

By "riveting-set assembly" is meant here an assembly of elements fastened together and including a riveting set, which is a piece intended to exert an impact on the rivet, this piece preferably being made of a material which can withstand a large number of impacts without deforming or degrading, a mass, the inertia of which is designed depending on the result desired, and possibly linkage means for linking the riveting set and the mass to the driving means.

The electric motor must have a high starting torque, with respect to its weight and its overall size, so as best to communicate the desired kinetic energy. In the current state of the art, brushless motors are those which best satisfy these conditions.

Preferably, the path of each riveting set with respect to the support device is rectilinear. This arrangement is known in the prior art. It will be noted that other paths are possible. For example, in order to reduce friction, it is possible to arrange for the riveting-set assembly to be mounted on a pivoting arm.

Advantageously, the driving means include at least one ball screw which comprises a shaft and a cage, one of these components being driven by the motor and the other being designed to drive the riveting-set assembly along its path. This arrangement is particularly advantageous if the path of the riveting set is rectilinear since the linkage between the cage and the riveting-set assembly can be very simple. In this regard, it will be noted that it is preferable in all cases for the linkage between the riveting-set assembly and the driving means to include shock-absorbing means in order to protect these driving means, and the motor itself, from the shock corresponding to the impact of the riveting set on the rivet.

According to an advantageous embodiment, at least one carrier device is an effector mounted on a robot arm, and the carrier devices are provided with means for clamping the workpieces to be riveted against each other before riveting, without imposing unacceptable stresses or movements on them.

Such means are described in the document EP-A-0,402,222 in the name of the Applicant.

Advantageously, the means for clamping the workpieces consist of tubular devices inside which the riveting set can travel. Such means are also described in the document EP-A-0,402,222.

The invention also relates to a method for operating the apparatus which has just been described, this process including the following steps:

a) storing in memory parameters relating to a hole prepared in two workpieces to be fastened by riveting and relating to a rivet intended to be inserted into the hole for the purpose of riveting, as well as parameters relating to the riveting-set assembly and to the driving means;

b) bringing each of the riveting sets into an approximately fixed initial position with respect to the workpieces to be fastened and to the rivet;

c) accurately determining the relative positions of the riveting sets, of the rivet and of the workpieces to be joined by riveting;

d) computing, as a function of said parameters stored in memory and of said position data, at least one parameter chosen from the time delay between starting each of the riveting-set assemblies and the distance of each of the riveting sets from the rivet at the moment of starting; and e) actuating each of the driving means, depending on the result of the calculations in step d).

Preferably, this process includes, after step c) and before step e), an additional step consisting in bringing the rivet into a position fixed in advance with respect to the workpieces to be joined by riveting.

This additional step makes it possible to prevent some of the kinetic energy of one of the riveting-set assemblies from being used to move the rivet before the impact of the other riveting set.

Position fixed in advance will be understood to mean an average position fixed in advance in the case where it is necessary to take account of the tolerances relating to the length of the rivet.

Advantageously, in order to move the rivet, the drive motor of a riveting set is used which operates at a slow speed.

BRIEF DESCRIPTION OF THE DRAWINGS

The invention will now be explained in more detail using a practical example, illustrated by the drawings, in which.

DESCRIPTION OF THE PREFERRED EMBODIMENT

Figure 1:
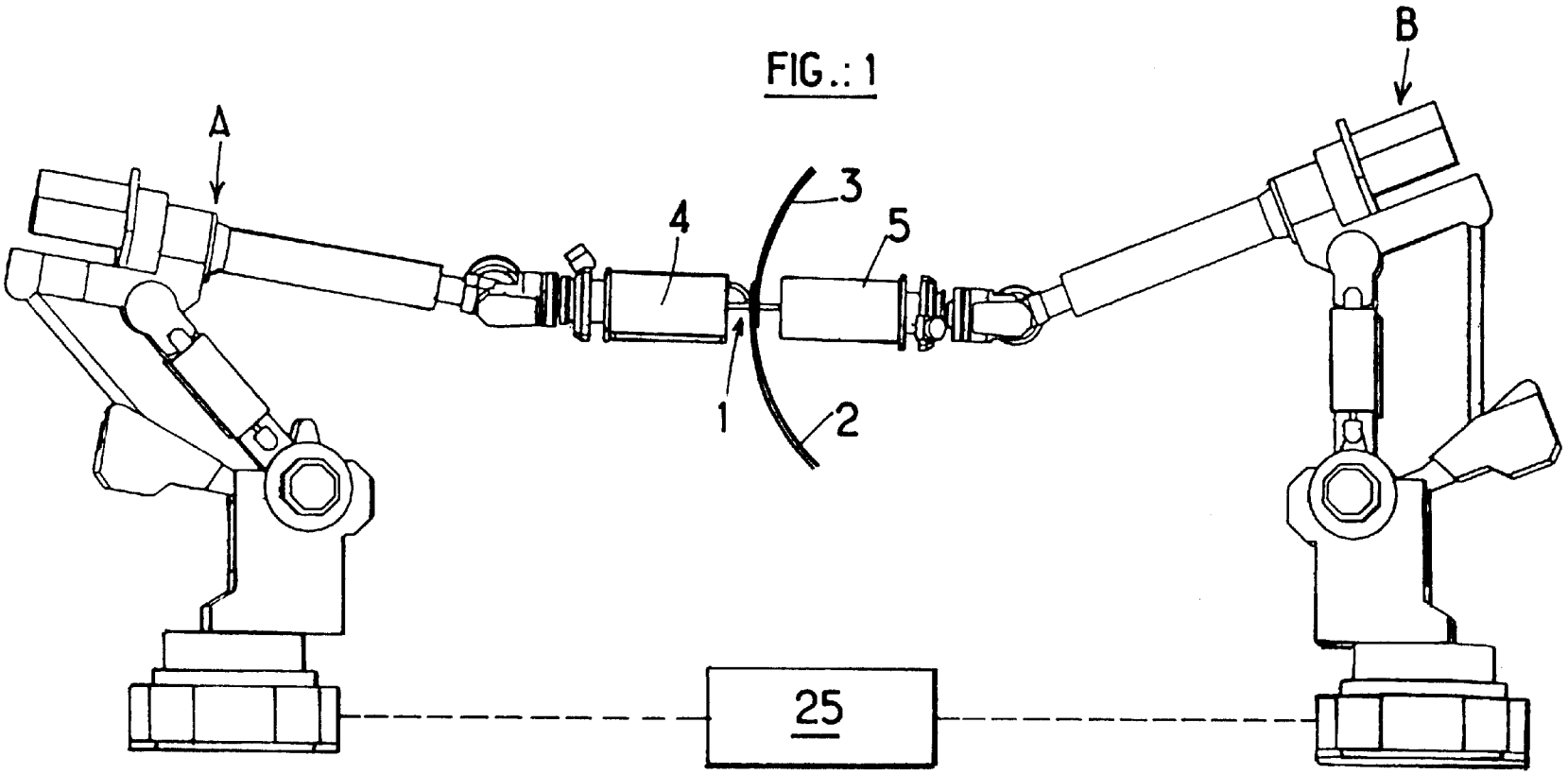
FIG. 1 is a diagrammatic overall view, in elevation, of an apparatus according to the invention.

The apparatus described is shown in the position in which it is ready to form a rivet 1 pushed into a hole which goes through two sheet-metal workpieces 2 and 3 which are to be joined together by riveting.

The apparatus includes two assemblies 4 and 5, which are identical and act in opposite directions. Each assembly is mounted on a separate robot arm A, B, these arms being placed in front of the opposite faces of the workpieces 2 and 3 to be joined. The assembly 4, on the left in FIGS. 1 and 2, will be described hereinbelow, it being understood that the assembly 5 comprises the same elements.

The assembly 4 includes a rear mounting plate 6, which carries means 7 for coupling to the corresponding robot arm A. The assembly 4 also includes a front mounting plate 8, fixably linked to the rear mounting plate 6 by rigid side members 9. The mounting plate 8 carries a docking nose 10 which is mounted on the front mounting plate 8 so as to be able to move along an axis 11 which, in the active position, is approximately coincident with the axis of the rivet 1. The docking nose 10 can move with respect to the mounting plate 8 and is provided with means, not shown, which exert on the docking nose 10 a force tending to move said docking nose away from the mounting plate toward the workpiece 2, so as to keep the workpieces 2, 3 in position and to clamp them together, in co-operation with the docking nose 10 of the effector 5.

The assembly 5 is arranged in such a manner that its axis 11 is also coincident with the axis of the rivet and in such a way that its docking nose 10 exerts a force on the workpiece 3 equal to that which the docking nose of the assembly 4 exerts on the workpiece 2, thereby keeping these two workpieces clamped against each other on condition, of course, that the robot arms carrying the two mounting plates 6 are immobilized.

The frame, consisting of the mounting plates 6, 8 and the side members 9, carries a guide tube 12 whose axis 11 coincides with that of the docking nose. A riveting mass 13 can slide inside this guide tube, which riveting mass carries, rigidly, at its end facing toward the docking nose 10, a riveting set 14 of smaller diameter. The mass 13 slides with loose fit in the guide tube 12.

Figure 3:
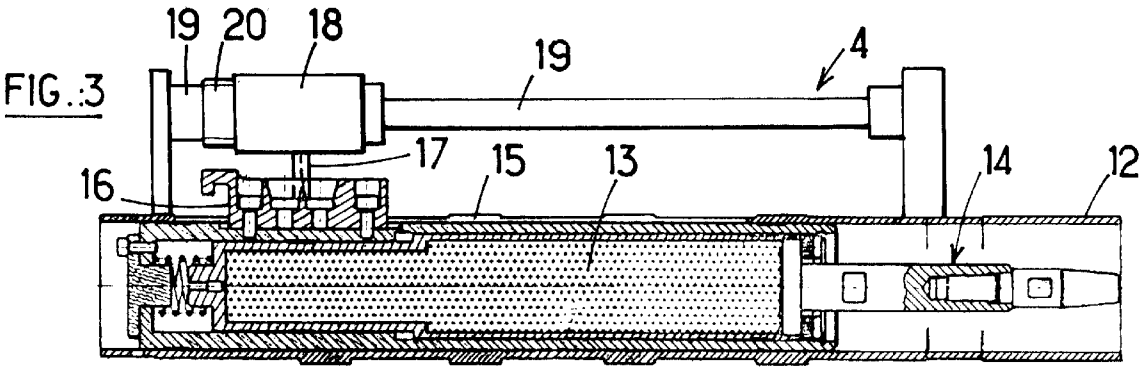
FIG. 3 is a partial section, on a plane perpendicular to that of FIG. 2.

The tube 12 has a longitudinal slot 15 (see FIG. 3) through which passes a linkage piece 16 which is fastened to the mass 13 and engages with a driving plate 17. This driving plate is fastened to two cages 18, each forming part of a ball screw device. The shafts 19 of these two ball screw devices have their axes parallel to the axis 11 and are prevented from moving axially with respect to the frame, formed by the mounting plates 6 and 8 and the side members 9, by fixed supports 20.

The shafts 19 of the ball screws are rotationally driven by a brushless electric motor 21 via conventional transmission 22. Provision could also be made for at least one of the shafts 19 to be driven directly by an electric motor. The rotation of the motor 21 is designed to be converted, by means of the ball screws 18, 19, into a rectilinear movement of the riveting-set assembly 13 and 14, so as to move this riveting-set assembly toward the rivet at a controlled speed and/or acceleration.

A reverse arrangement, with the cages 18 rotationally driven by the motor and the shafts 19 translationally fastened to the riveting-set assembly, is, of course, possible.

Figure 2:
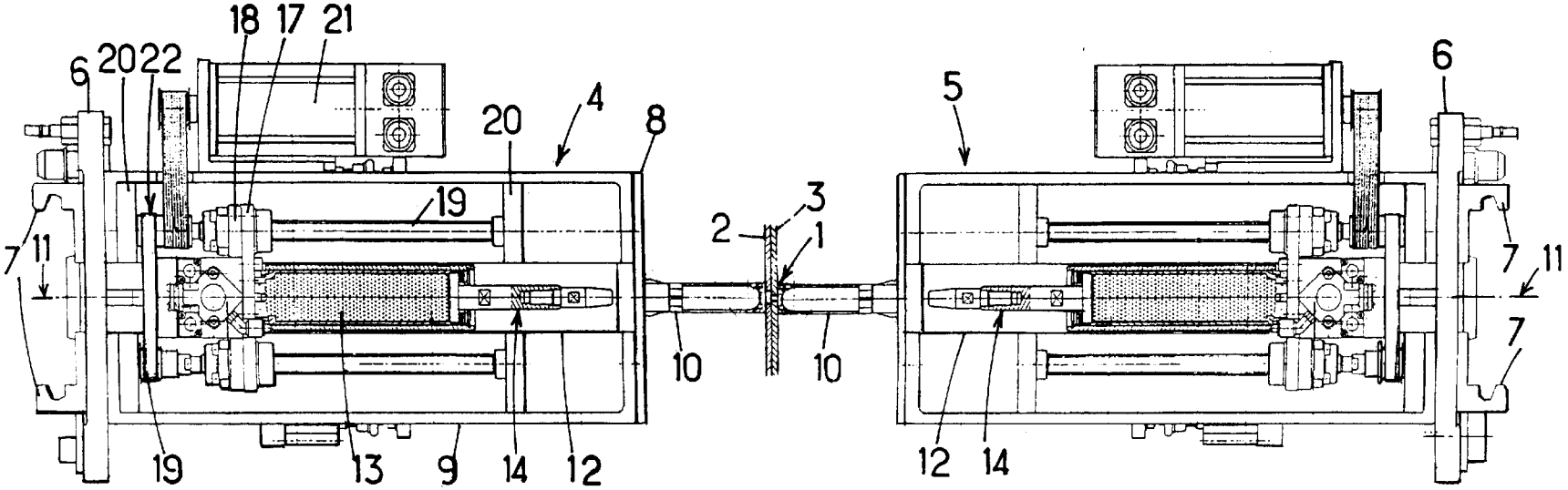
FIG. 2 is a view, in elevation and in partial section, of the apparatus, on a larger scale.

Shown symbolically at 25 in FIG. 1 is a control unit linked to both robot arms A and B. This unit is capable of processing data which relate to the various parameters of the operation and are stored beforehand in memory or are transmitted via sensors mounted on the effectors and of sending control signals for the two motors 21 at selected times depending on these parameters.

I claim:

1. An apparatus for joining workpieces by riveting, said apparatus comprising a first tool and a second tool for acting in a substantially synchronous manner on opposite ends of a rivet, said first and second tools respectively comprising:

first and second carrier devices;

a first riveting-set assembly including a first riveting set and a second riveting-set assembly including a second riveting set, said first and second riveting-set assemblies being respectively mounted on said first and second carrier devices;

first and second guiding means for respectively moving each of said first and second riveting-set assemblies along a defined path;

means for keeping each of said first and second carrier devices in a position respectively to move an active face of one of said first and second riveting sets substantially along a path parallel to an axis of said rivet, when said active face comes into contact with a corresponding end of the rivet;

driving means for driving each of said first and second carrier devices, said driving means comprising first and second electric motors for respectively imparting a velocity to a corresponding one of said first and second riveting sets moving along its said path toward the other one of said first and second riveting sets, said velocity being sufficient to provide the riveting set with sufficient kinetic energy to form the rivet; and control means for actuating said driving means to drive said first and second carrier devices approximately simultaneously.

2. The apparatus as claimed in claim 1, wherein the first and second electric motors are brushless motors.

3. The apparatus as claimed in claim 1, wherein the driving means include at least one ball screw device which comprises a shaft and a cage, one of said shaft and said cage being rotationally driven by one of the first and second motors and the other of said shaft and said cage being designed to drive one of said first and second riveting-set assemblies along said path.

4. The apparatus as claimed in claim 1, wherein at least one of said first and second carrier devices is an effector mounted on a robot arm and the first and second carrier devices are provided with means for clamping the workpieces to be riveted against each other before riveting, without imposing unacceptable stresses or movements on them.

5. The apparatus as claimed in claim 4, wherein the means for clamping the workpieces comprise tubular devices inside which one of the first and second riveting sets can travel.

6. The riveting apparatus as claimed in claim 1, wherein each of the first and second guiding means, first and second riveting-set assemblies and driving means is designed to be mounted on an effector on which are also mounted means for keeping in position two workpieces to be joined by riveting and for clamping said workpieces together, and means for bringing a rivet into a hole in said workpieces.

7. The apparatus as claimed in claim 6, wherein said effector also carries means for determining the exact shape of said hole, the information delivered by said means for determining being used by said control means in order to define the movements of the first and second riveting-set assemblies.

8. The apparatus as claimed in claim 1, wherein said first and second riveting sets encounter the rivet to be formed with a time delay and with a kinetic energy difference which are less than selected limits in order to avoid, at the workpieces to be joined, excessive movements or stresses.

9. The apparatus as claimed in claim 1, wherein said first and second electric motors both (i) drive the first and second riveting-set assemblies along said path and (ii) impart the velocity to the first and second riveting-set assemblies.

* * * * *